United States Patent [19]

Landström

[11] Patent Number: 4,535,696

[45] Date of Patent: Aug. 20, 1985

[54] DEVICE FOR UNDERWATER MISSILES FOR USE AGAINST SUBMERGED SUBMARINES

[76] Inventor: Sven Landström, Fjäelgatan 16, Stockholm, Sweden, S-116 45

[21] Appl. No.: 527,866

[22] Filed: Aug. 30, 1983

[30] Foreign Application Priority Data

Aug. 31, 1982 [GB] United Kingdom ..... 8224837

[51] Int. Cl.[3] ..... F42B 15/10

[52] U.S. Cl. ..... 102/380; 102/273; 102/417; 102/422

[58] Field of Search ..... 102/273, 380, 417, 421, 102/422

[56] References Cited

U.S. PATENT DOCUMENTS

| | | | |
|---|---|---|---|
| 2,599,579 | 6/1952 | Park et al. | 102/380 |
| 2,946,261 | 7/1960 | Crockett | 102/380 X |
| 3,016,012 | 1/1962 | Turlay | 102/422 |
| 3,855,933 | 12/1974 | Messineo | 102/56 |
| 3,995,574 | 12/1976 | Drimmer | 114/20 R |
| 4,004,521 | 1/1977 | Andrejkovics | 102/273 X |
| 4,433,626 | 2/1984 | Landstrom | 102/390 |

FOREIGN PATENT DOCUMENTS

| | | |
|---|---|---|
| 578771 | 7/1946 | United Kingdom . |
| 735012 | 8/1955 | United Kingdom . |
| 808032 | 1/1959 | United Kingdom . |
| 1483478 | 8/1977 | United Kingdom . |

*Primary Examiner*—Peter A. Nelson

*Attorney, Agent, or Firm*—Holman & Stern

[57] ABSTRACT

A device for underwater missiles for use against submerged submarines, said missiles including a housing (1) having a front portion, intended to contact the outside surface of a submarine. According to the invention, a tubular ring member (6) is rotatably attached to the front portion of the housing (1), said ring member (6) being arranged to take up a rotary movement in relation to the housing (1) when contacting the outside surface of a submarine. In order to facilitate rapid acceleration of the ring member (6) into said rotary movement, the ring member (6) is attached to the housing (1) by means of a ball bearing joint (7) or any other known low-frictional rotary joint or connection, and the mass of the ring member (6) is also considerably smaller than the total mass of the missile. The outer surface(s) of the ring member (6) is/are also preferably arranged with means intended to increase the frictional contact between the ring member (6) and the outer surface of a submarine on impact, e.g. a layer or coating of a material having a high frictional coefficient, an irregular surface, or means directed outwardly from the ring member (6).

17 Claims, 5 Drawing Figures

DEVICE FOR UNDERWATER MISSILES FOR USE AGAINST SUBMERGED SUBMARINES

BACKGROUND OF THE INVENTION

The present invention relates to a device for underwater missiles for use against a submerged submarine. The term "underwater missile" is used in respect of all types of missiles which can be launched against a submerged submarine, i.e. either including an explosive charge, intended to penetrate the submarine, or including first means facilitating adherence against the outer surface of the submarine and second means which facilitate the possibility of tracking the submarine, when a position of adherance has been accomplished.

With regard to missiles including an explosive charge, intended to penetrate through a submerged submarine, said charges are usually of shaped type, whereby a relatively small explosive charge can penetrate through the outside and inside hull of a submarine. However, the directed explosive force from a shaped charge makes it necessary to align the missile substantially perpendicular in relation to the outside surface of the submarine, before detonating the charge. There are both explosive and non-explosive types of missiles, arranged to magnetically adhere to the outside surface of a submarine. If the magnetic contact surface of such a missile should not take up contact with the outside surface of a moving submerged submarine with a relatively small angle of inclination, there is an obvious risk that the missile will not adhere to the outside surface of the submarine. Practical tests have shown, that only a small percentage of the missiles, which in fact hit a moving submerged submarine, do adhere to same.

SUMMARY OF THE INVENTION

The object of the present invention is to afford a device for underwater missiles for use against submarines which improves the alignment of the missile when a first contact is made with the outside surface of a submerged submarine. With regard to missiles which magnetically adhere to the outside surface of a submarine, practical tests have shown that the majority of the missiles according to the invention, which hit a moving submerged submarine, also adheres to same. The present invention can thus be regarded as a considerable improvement over existing underwater missiles for use against submerged submarines. Furthermore, many existing types of underwater missiles can also easily be adapted for use of the device according to the present invention.

The device according to the present invention relates to missiles including a housing having a front portion, intended to contact the outside surface of a submarine, and is mainly characterised in that a tubular ring member is rotatably attached to the front portion of the housing, said ring member being arranged to take up a rotary movement in relation to the housing when making contact with the outside surface of a submarine in motion.

BRIEF DESCRIPTION OF THE DRAWINGS

An embodiment of a device according to the present invention is more fully described below, reference being made to the accompanying drawings, in which:

FIGS. 2A, 2B and 2C shematically illustrate how the missile disclosed in FIG. 1 makes contact with the outside surface of a submarine.

DETAILED DESCRIPTION OF THE INVENTION

Figure 1:
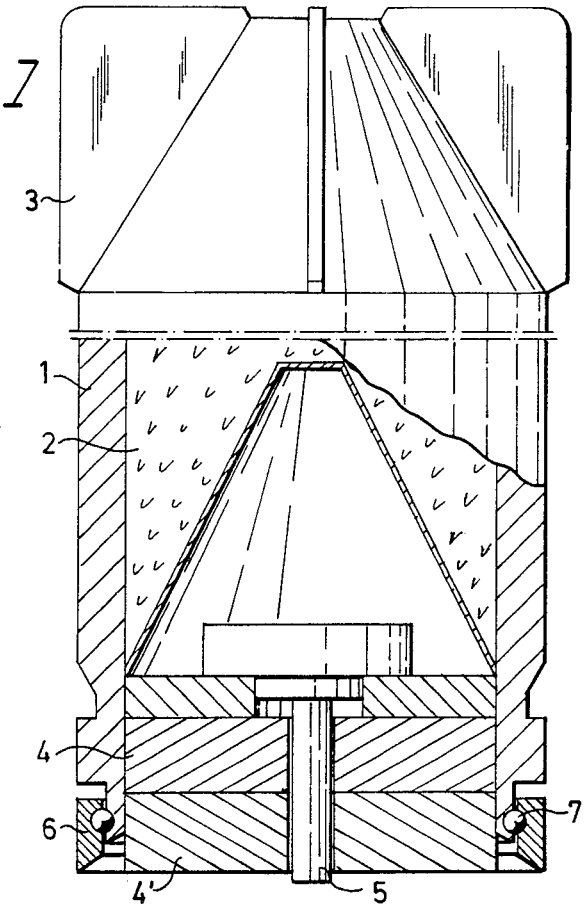
FIG. 1 is a side view, partly in cross-section, of an explosive underwater missile, arranged to magnetically adhere against the outside surface of a submerged submarine, using with a device according to the present invention.

With reference to the embodiment shown in FIG. 1, same comprises a housing 1, enclosing a shaped explosive charge 2. The rear end portion of the housing 1 is arranged with outwardly extending fins 3, intended to stabilize the missile while travelling towards a submarine after launch. The forward end portion of the housing 1 is arranged with magnets 4, 4', intended to facilitate adherance against the outside surface of the submarine, and an igniting means 5 is also shown, intended to ignite the explosive charge when the missile has adhered against the outside surface of a submarine. The outer portion of the magnets 4, 4' is arranged surrounded by a tubular ring member 6, rotatably attached to the housing 1. In order to minimize the friction between the housing 1 and the ring member 6, a ball bearing joint 7 is arranged between the housing 1 and the ring member 6, thus facilitating a rotary movement of the ring member 6 in relation to the housing 1, but preventing axial displacement.

When the missile shown in FIG. 1 is launched against a submerged submarine, it will be moving in a direction which intercepts the course of the submarine. Furthermore, the water layer most adjacent to the submarine will be affected by the movement of the submarine. These factors, and the outside shape of the submarine, make it extremely unlikely that the missile should contact the outside surface of the submarine with the magnetic contact surface perpendicularly aligned with the outside surface of the submarine. The most likely position of impact would be with the magnetic contact surface located in an inclined relationship to the outside surface of the submarine, i.e. with a forward outer edge portion in contact with the submarine.

Now assuming that a conventional missile is launched from the surface against a submerged and moving submarine, with the missile located in an inclined relationship to the outer surface of the submarine when impact occurs, the direction of travel for the missile approaching the submarine would obviously not coincide with the direction of travel for the submarine. When impact occurs, the movement of the submarine would thus cause the missile to rotate rapidly around its centre axis, having a peripheral speed mainly corresponding to the speed of the submarine. Furthermore, the force of gravity would cause the missile to move downwards along the submarine with a rotary movement, and to loose contact with the submarine after a short interval of time. This period of time, i.e. while the missile is maintaining contact with the submarine, is often not sufficient for the missile to facilitate alignment of the contact surface in such a close relationship to the surface of the submarine that the missile adheres to same.

However, when a missile, as disclosed with reference to FIG. 1, is launched against a submerged submarine, the outside edge portion of the ring member 6 would first make contact with the outside surface of the submarine, where the length axis of the missile is at an inclined angle in relation to the outside surface of the submarine when impact occurs. The ring member 6, having a low mass and being rotatable in relation to the housing 1, would rapidly be accelerated to compensate for the difference in direction of travel between the missile and the submarine. Since the ring member 6 has a mainly non-frictional connection to the missile, which also has a considerably larger mass, the rotary movement of the ring member 6 would not be transferred to the missile. By transforming the differences in travel to a rotary movement of the ring member 6, the period of time in which the missile is in contact with the submarine is considerably prolonged, and the possibility for the missile to align itself into contact position against the outside surface of the submarine is thus greatly enhanced. The effect on impact can thus be compared to a missile launched against a stationary target, since the missile will move with the submarine at a speed corresponding to the speed of the zone adjacent to the submarine.

The above described operation is schematically illustrated in FIGS. 2A, 2B and 2C, in which FIG. 2A shows a missile initially making contact with the outside surface of a submerged submarine, FIG. 2B shows how the ring member 6 is used as a compensating means for the differences in direction of travel for the missile and the submarine, FIG. 2C shows the missile when aligned into the final position of adherance against the submarine.

Figure 3:
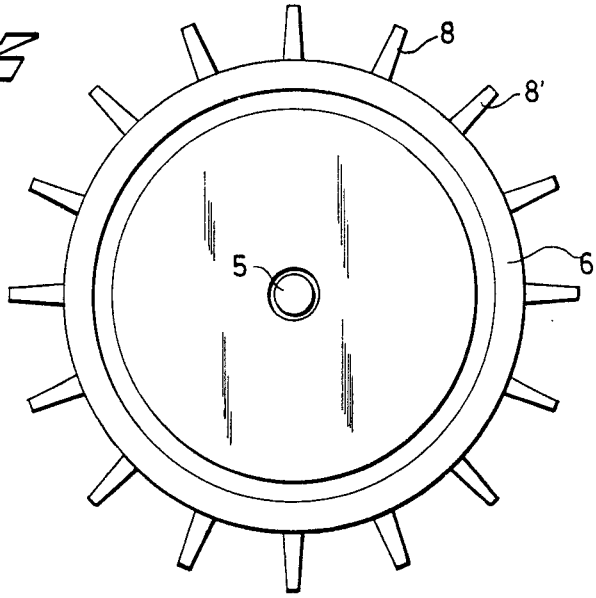
FIG. 3 shows a front view of the missile shown in FIG. 1, with the device according to the present invention slightly modified.
Figure 9A:
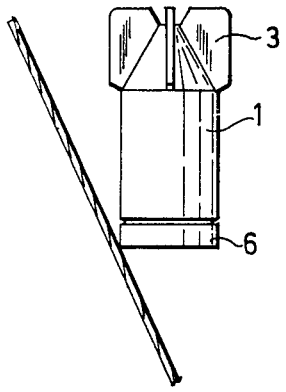
Figure 9B:
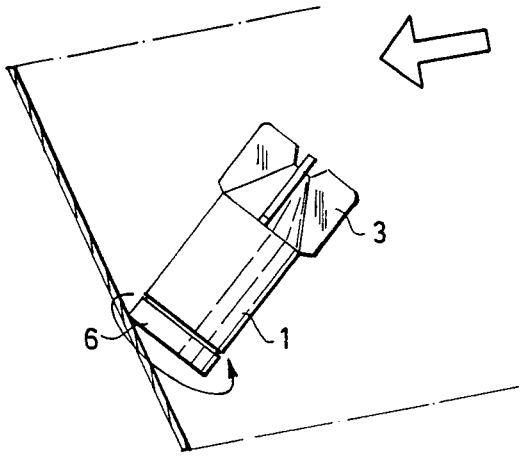
Figure 9C:
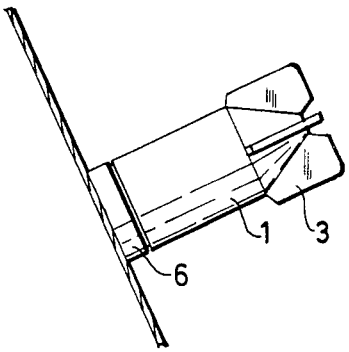

In order to facilitate rapid acceleration of the ring member 6 into a rotary movement, the ring member 6 should have a low mass, and also be connected to the housing 1 in a mainly non-frictional relationship, e.g. by means of a ball bearing joint 7 or by any other previously known type of rotatable joint means, which provides low friction. A further factor of importance is that the ring member 6 should make good frictional contact with the outside surface of the submarine on impact. In order to establish such a contact, the ring member 6 may be arranged with an external surface having a high frictional coefficient, or it may be arranged with means intended to improve the frictional contact between the ring member 6 and the submarine. Such means can be provided in a number of ways, e.g. by giving the outside surface of the ring member 6 an irregular configuration having preferably pointed and sharp portions extending outwardly. It is also possible to provide the ring member 6 with a number of studs 8, 8', extending in a spaced relationship from each other radially in direction from the ring member 6. An example of such a modification is shown in FIG. 3, showing a number of pointed studs 8, 8' extending outwardly from the ring member 6.

The embodiments shown and described above relate mainly to missiles of explosive or non-explosive type, which magnetically adhere to a submarine. However, it should be emphasized, that the present invention is in no way restricted to only missiles intended to adhere magnetically to a submarine. Missiles of other types, which may include an explosive charge, intended to be detonated on impact also can be improved according to the present invention. Particularly when such missiles include an explosive charge of shaped type, the missile, and the charge, should preferably be aligned mainly perpendicular to the outside surface of the submarine, before the charge is detonated. These types of missiles also can be improved with a device according to the present invention, since the position at impact could be improved, before the explosive charge is detonated. In another embodiment of this invention, the missile may be of a non-explosive type, arranged to magnetically adhere to a submarine and to facilitate tracking of the same by the transmission of audio signals and/or the dispersion of visible substances such as colored liquid.

The present invention is thus in no way restricted to the embodiments shown and described, which are only intended to serve as examples of embodiments within the scope of the inventive thought.

I claim:

1. In a device for underwater missiles for use against submerged submarines, said missiles including a housing having a front portion, intended to contact the outside surface of a submarine, the improvement comprising a tubular ring member rotatably attached to the front portion of the housing, said ring member being arranged to take up a rotary movement in relation to the housing when making contact with the outside surface of a submarine in motion.

2. The improvement of claim 1, in which the ring member is attached to the housing by a low-frictional rotary joint means, facilitating rotation of the ring member in relation to the housing with low frictional loss.

3. The improvement of claim 1, in which the mass of the ring member is considerably smaller than the total mass of the missile.

4. The improvement of claim 1, in which the outer surface of the ring member has a coating or layer of friction improving material.

5. The improvement of claim 1 in which the outer surface of the ring member has an irregular configuration, arranged to improve frictional contact with the outer surface of a submarine.

6. The improvement of claim 1, in which the ring member is arranged with a number of studs, located in a spaced relationship to each other and extending substantially radially and outwardly from the ring member.

7. The improvement of claim 1 in which the ring member encloses at least one magnet, arranged to facilitate magnetic adherence of the missile against the outer surface of a submarine, and in which the contact surface of the magnets is located in substantially the same plane as the end face surface of the ring member.

8. The improvement of claim 1, in which an igniting or triggering means is arranged enclosed by the ring member, located in such a relationship to the ring member that it is activated when the end face surface of the ring member is substantially aligned with the outer surface of the submarine.

9. The improvement of claim 1, in which the missile is of an explosive type, including at least one explosive charge, of a shaped type, arranged to penetrate the submarine when detonated.

10. The improvement of claim 1 in which the missile is of a non-explosive type, arranged to magnetically adhere to a submarine and to facilitate tracking of the same by the transmission of signals.

11. The improvement of claim 2 wherein the rotary joint means is a ball bearing joint.

12. The improvement of claim 4 wherein the friction improving material is an abrasive material.

13. The improvement of claim 5 wherein the outer surface of the ring member is grooved.

14. The improvement of claim 5 wherein the outer surface of the ring member has a sharp peripheral edge portion.

15. The improvement of claim 1 in which the missile is of a non-explosive type, arranged to magnetically adhere to a submarine and to facilitate tracking of the same by the dispersion of visible substances.

16. The improvement of claim 15 wherein the visible substance is a colored liquid.

17. The improvement of claim 10 wherein the signal is an audio signal.

* * * * *